US007063208B2

(12) United States Patent
Lebras

(10) Patent No.: US 7,063,208 B2
(45) Date of Patent: Jun. 20, 2006

(54) ARTICLE CARRIER AND BLANK THEREFOR

(75) Inventor: Philippe Lebras, Chateauroux (FR)

(73) Assignee: MeadWestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 10/923,175

(22) Filed: Aug. 20, 2004

(65) Prior Publication Data

US 2005/0103651 A1 May 19, 2005

Related U.S. Application Data

(63) Continuation of application No. PCT/US03/05391, filed on Feb. 21, 2003.

(30) Foreign Application Priority Data

Feb. 21, 2002 (GB) ..... 0204090.5

(51) Int. Cl.
*B65D 75/00* (2006.01)

(52) U.S. Cl. ..... 206/163; 206/162; 206/170

(58) Field of Classification Search ..... 206/162, 206/170, 200, 427, 163
See application file for complete search history.

(56) References Cited

U.S. PATENT DOCUMENTS

| | | | | |
|---|---|---|---|---|
| 1,984,611 | A | 12/1934 | Weaver | |
| 2,175,600 | A | 10/1939 | Greco | |
| 2,375,631 | A * | 5/1945 | De Villard | 206/194 |
| 2,714,982 | A | 8/1955 | Strauss | |
| 2,802,597 | A * | 8/1957 | Davis | 206/165 |
| 4,146,168 | A | 3/1979 | Hartline | |
| 4,341,341 | A | 7/1982 | Roccaforte | |
| 5,400,901 | A | 3/1995 | Harrelson | |
| 5,427,308 | A * | 6/1995 | Swift et al. | 229/125.27 |
| 6,695,137 | B1 * | 2/2004 | Jones et al. | 206/166 |

FOREIGN PATENT DOCUMENTS

| | | |
|---|---|---|
| DE | 27 23 957 A | 11/1978 |
| FR | 2 376 040 A | 7/1978 |
| WO | WO 01/72599 A2 | 10/2001 |
| WO | WO 02/14175 A1 | 2/2002 |

* cited by examiner

*Primary Examiner*—David T. Fidei
(74) *Attorney, Agent, or Firm*—Tsugihiko Suzuki

(57) ABSTRACT

An article carrier and a blank for forming an article carrier for carrying one or more articles comprising a plurality of panels for forming the opposed sides and ends of the article carrier including a pair of laterally spaced top wall panels hingedly connected to the opposed side walls. A carrying handle is hinged to the top wall panels. The handle is movable between a retracted position when the handle does not extend above the top of the articles and a deployed position whereby the handle protrudes above the article tops.

14 Claims, 5 Drawing Sheets

ARTICLE CARRIER AND BLANK THEREFOR

This is a continuation of international application No. PCT/US03/05391, filed Feb. 21, 2003, which is hereby incorporated by reference.

BACKGROUND OF THE INVENTION

This invention relates to an article carrier, for example a basket type, adapted to accommodate a plurality of articles, such as bottles and to a blank for forming the carrier. In particular, the invention relates to a retractable handle for an article carrier.

Normally article carriers include a handle structure by which the carrier can be lifted and carried and the bottles are arranged in rows on either side of the handle structure. A problem associated with such carriers is that as the handle protrudes above the bottle tops it makes it harder to stack the carriers during transit because the handle arrangement may become deformed or may even tear if another carrier is mounted on top. Accordingly, known article carriers are not suited to stacking.

SUMMARY OF THE INVENTION

The present invention and its preferred embodiments seek to overcome or at least mitigate the problems of the prior art.

A first aspect of the present invention provides an article carrier for carrying one or more articles for example bottles, comprising a plurality of panels for forming the opposed sides and ends of the article carrier including a pair of laterally spaced top wall panels hingedly connected to opposed side wall panels and a carrying handle hinged to the top wall panels wherein the handle is movable between a retracted position when the handle does not extend above the top of the articles and a deployed position whereby the handle protrudes above the article tops.

Preferably, the top wall panels are sized and hingedly connected to the handle such that each side wall panel flexes in a resilient manner. The arrangement is such that the top wall panels are put into tension during initial lifting or lowering movement of the handle and are relaxed by further movement of the top panels to cause a pop-up effect when lifting the handle and a retracting effect when lowering the handle.

Optionally, the pop-up effect occurs when the top wall panels move upwardly above the horizontal plane containing the upper edges of the side walls and the retracting effect occurs when the top wall panels move downwardly below the horizontal plane containing the upper edges of the side walls.

According to an optional feature of this aspect of the present invention there further comprises an intermediate panel hingedly connecting each top wall panel to the handle. The intermediate panel is adapted to move from downward orientation in the retracted position to an upward orientation in the deployed position so as to enable the handle to flex relative to the top wall panels.

According to another optional feature of this aspect of the present invention each of the top wall panels further comprises one or more apertures to receive an upper portion of an article.

Preferably the aperture is ellipsoidal in shape so as to be circular in diameter in both the deployed and retracted positions.

According to an optional feature of this aspect of the present invention the carrier is a basket type carrier.

A second aspect of the present invention provides a blank for forming an article carrier for carrying one or more articles comprising a plurality of panels for forming the opposed sides and ends of the article carrier hingedly connected together and a pair of laterally spaced top wall panels hingedly connected to the respective side wall panels and a handle panel hinged to the top wall panel.

Preferably the top panels are sized and hingedly connected to the handle such that each side wall flexes in a resilient manner in a set up article carrier, the arrangement being such that the top wall panels are put into tension during initial lifting or lowering movement of the handle and are relaxed by further movement of the top panels to cause a pop-up effect when lifting the handle and a retracting effect when lowering the handle.

According to an optional feature of this second aspect of the present invention there further comprises an intermediate panel hingedly connecting each top wall panel to the handle, the intermediate panel is adapted to move from, downward orientation in the retracted position to an upward orientation in the deployed position so as to enable the handle to flex relative to the top wall panels in a set up article carrier.

According to another optional feature of the second aspect of the present invention the top wall panel further comprises one or more apertures to receive an upper portion of an article.

Preferably the aperture is ellipsoidal in shape.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENTS

Figure 1:
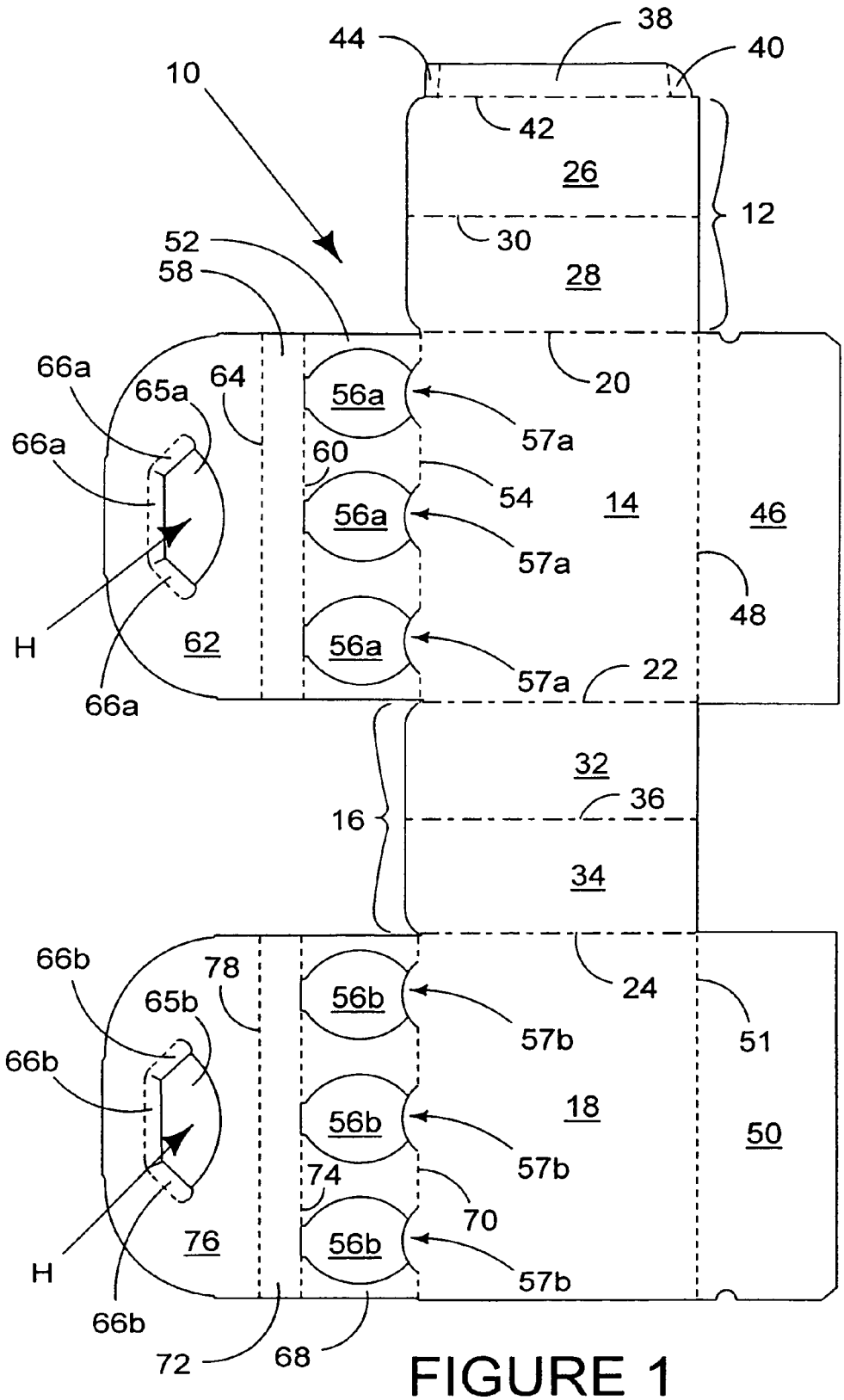
FIG. 1 is a plan view of a unitary blank from which an article carrier according to one aspect of the invention is formed.

Referring to the drawings and in particular FIG. 1, there is shown a blank 10 for forming an article carrier, which blank is formed from paperboard or other suitable foldable sheet material. The article carrier formed from the blank is adapted to accommodate a plurality of articles, for example six bottles arranged in two rows of three bottles each. It is envisaged that the carrier can be adapted to accommodate a different number and/or configuration of articles according to user requirements.

The blank 10 comprises a plurality of panels for forming the opposed sides, ends and base of an article carrier. In this embodiment there comprises a first end wall panel 12, first side wall panel 14, second end wall panel 16 and second side wall panel 18 hingedly connected one to the next in series along fold lines 20, 22 and 24 respectively.

In FIG. 1, an 'arrowhead' style basket carrier is formed, whereby the opposing ends are pushed together to separate the opposing side wall panels. In order to achieve this, the end wall panels are divided into two parts so that first end wall panel 12 comprises first part 26 and second part 28 hingedly connected together along fold line 30. Similarly second end wall panel 16 comprises first part 32 and second part 34 hingedly connected together along fold line 36. Of course, it is envisaged that in other embodiments, a 'parallelogram' style of basket carrier can be used without departing from the scope of invention.

One or more securing flaps 38, 40 and 44 are hingedly connected to an end edge of one of the end wall panels 12 to be secured to the opposing end of the carrier blank during construction of the carrier, described below.

Base wall panels 46 and 50 are provided which are, preferably, hingedly connected to first and second side wall panels 14 and 18 respectively along fold lines 48 and 51.

A handle structure H is provided and is connected to the sides or ends of the article carrier by means of one or more top wall panels, so that top wall panel 52 is hingedly connected to first side wall panel along fold line 54 and second top wall panel 68 is hingedly connected to second side wall panel 18 along fold line 70.

In FIG. 1, the handle structure H is provided by a pair of handle panels 62 and 76 which are hingedly connected to the respective one of the top wall panels 52, 68 along fold lines 64 and 78 respectively. Each handle panel is provided with a hand aperture 65*a*, 65*b* and one or more handle flaps 66*a*, 66*b* to provide a more comfortable handle arrangement. The top wall panel(s) 52, 68 further comprise one or more apertures 56*a*, 56*b* struck from their respective top wall panels 52, 68. The apertures may be elliptical in shape and viewed from above they are circular so as to receive an article, although other shapes are envisaged, without departing from the scope of the invention. The shape of the apertures in FIG. 1 enable the top panels to move from deployed to retracted positions, described in more detail below.

There may further comprise one or more protruding tabs 57*a*, 57*b* extending from the respective ones of the side wall panels 14, 18 respectively. In use, the protruding tabs provide additional protection for the upper portions of the articles.

In one class of embodiments, the handle structure H is allowed to flex relative the top wall panels 52, 68 and, to this end, intermediate panels 58 and 72 hingedly interconnect top wall panels 52 and 68 to the respective handle panels 62 and 76 along fold lines 60, 64 and 74, 78.

It is envisaged that the construction of the article carrier can be formed by a series of sequential folding and gluing operations in a straight line machine, so that the carrier is not required to be rotated or inverted to complete its construction. The folding process is not limited to that described below and may be altered according to particular manufacturing requirements.

Figure 2:
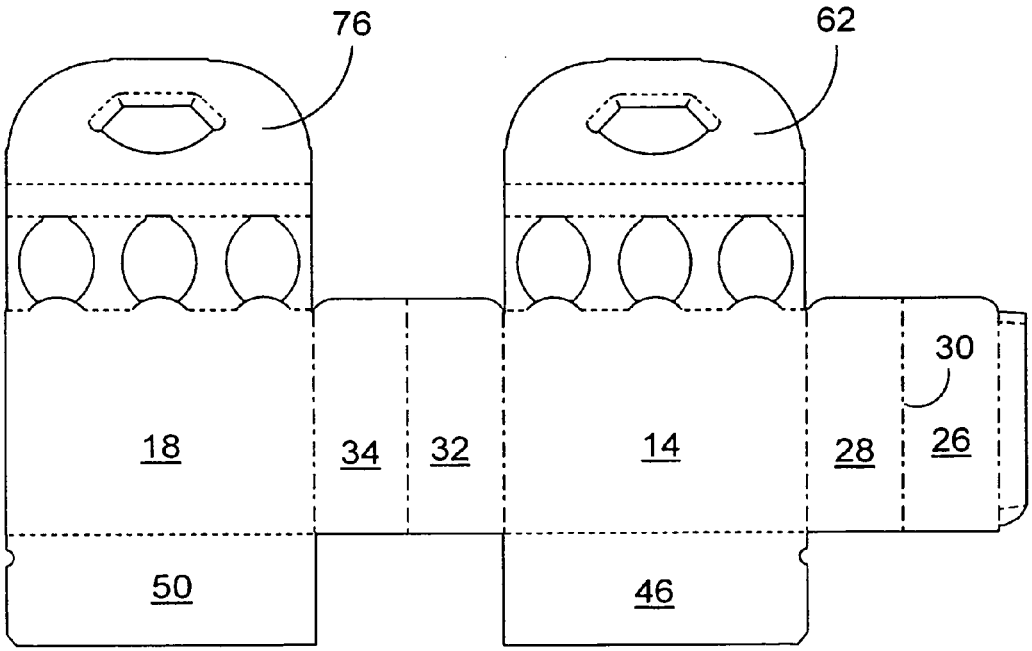
FIGS. 2, 3 and 4 illustrate the construction of the article carrier from the blank shown in FIG. 1.
Figure 3:
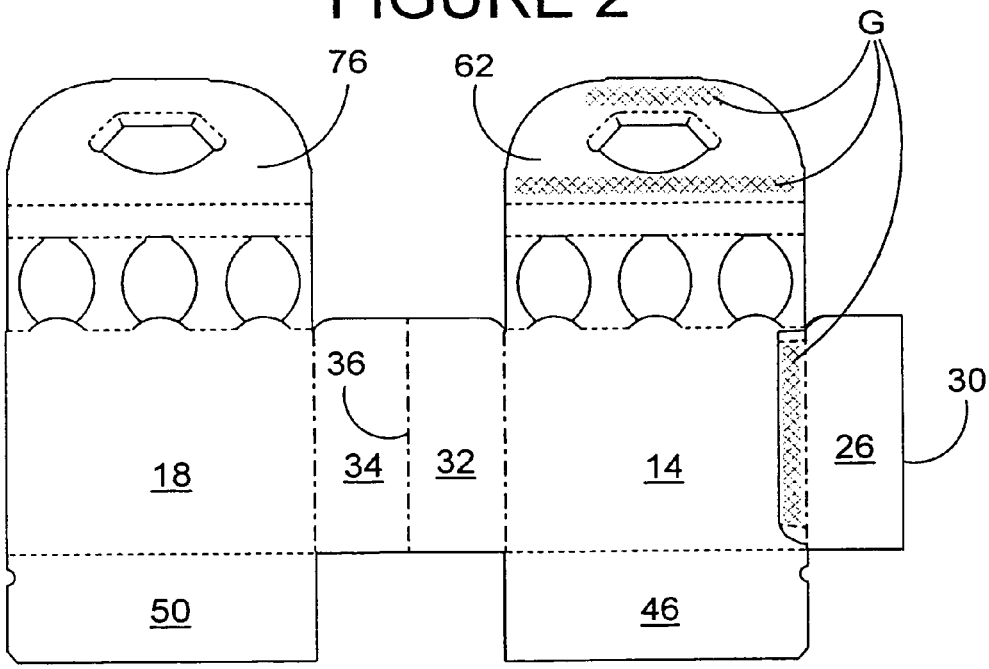
Figure 4:
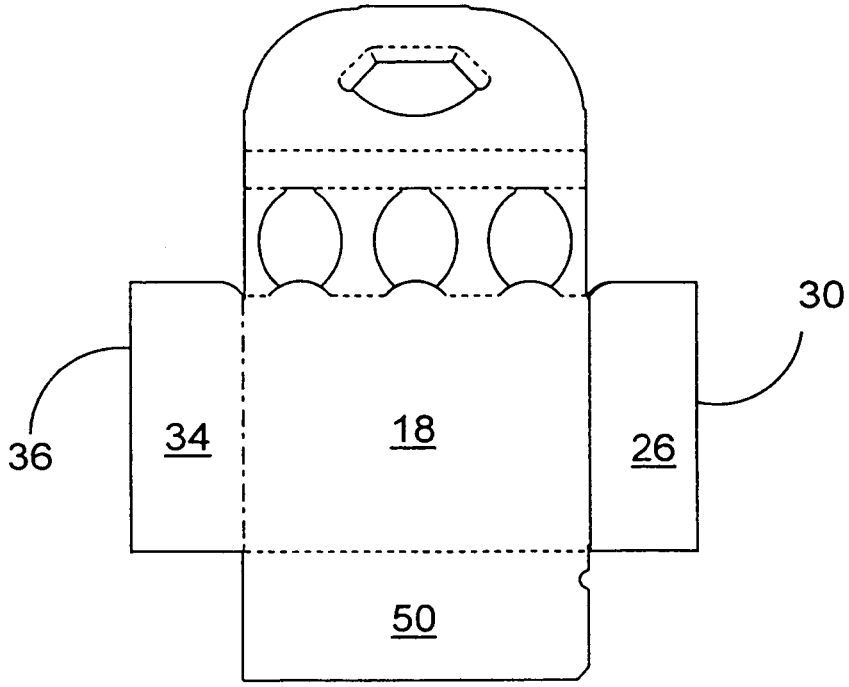

FIGS. 2, 3 and 4 illustrate the forming process of the carrier. The first stage of construction is to form the side and end walls so that panel 26 is folded inwardly along fold line 30 and in to face contacting arrangement with panel 28, shown in FIG. 3. Thereafter, second side wall panel 18 is folded inwardly about fold line 36 to replace overlapping arrangement with first side wall panel 14. Second side wall panel 18 is' secured to the securing flap 38 by glue G (FIG. 3) or other suitable means known in the art. Thus the carrier is in a flat collapsed condition as shown in FIG. 4, ready to be supplied to the user or bottling plant for loading and final construction.

In some embodiments, handle panels 62 and 76 are secured together by glue G or other suitable means known in the art.

Figure 5:
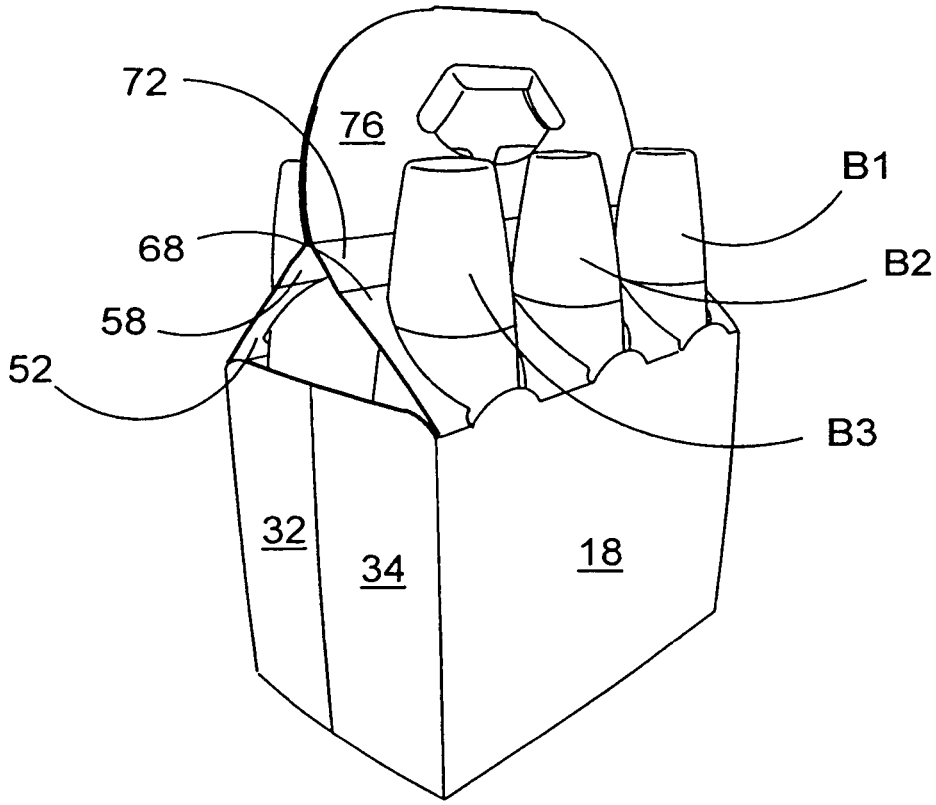
FIG. 5 illustrates the article carrier in a set up and loaded condition with the handle in a deployed position.

In order to erect the carrier of FIG. 4 the opposing end edges defined, at least in part, by fold lines 30 and 36, are pushed in an inward direction so as to separate panels 34, 18 and 26 from opposing panels 32, 14 and 28 respectively. Articles, for example bottles B1, B2 and B3 are loaded into the article carrier by relative vertical movement between the article carrier and the bottles, as is well known, and the outer portions of the bottles are inserted through the apertures 56*a* and 56*b*. Base panels 46 and 50 are folded inwardly and are secured together in overlapping arrangement, by glue or other suitable means, for example a locking tab arrangement, as is known in the art. The article carrier is then in a set up and loaded condition as shown in FIG. 5.

Figure 6:
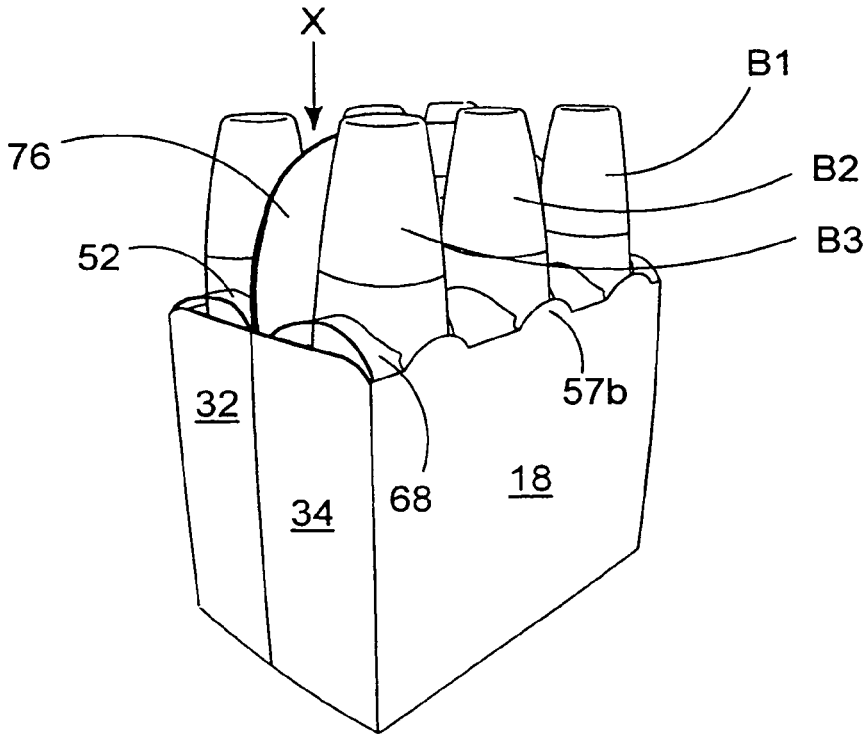
FIG. 6 is a perspective view of the article carrier shown in FIG. 5 with the handle structure in a retracted position.

In order to complete the construction of the carrier so that the article carriers can be shipped or stacked, the handle arrangement is pushed in a downward direction X, as shown in FIG. 6.

The top wall panels 52, 68 are sized and hingedly connected to the handle H such that each side wall panel 14, 18 and/or each top wall panel 52, 68 flexes in a resilient manner when the handle is moved downwardly. This causes the top wall panels 52, 68 to be put into tension during the initial lowering movement of the handle H.

Figure 7:
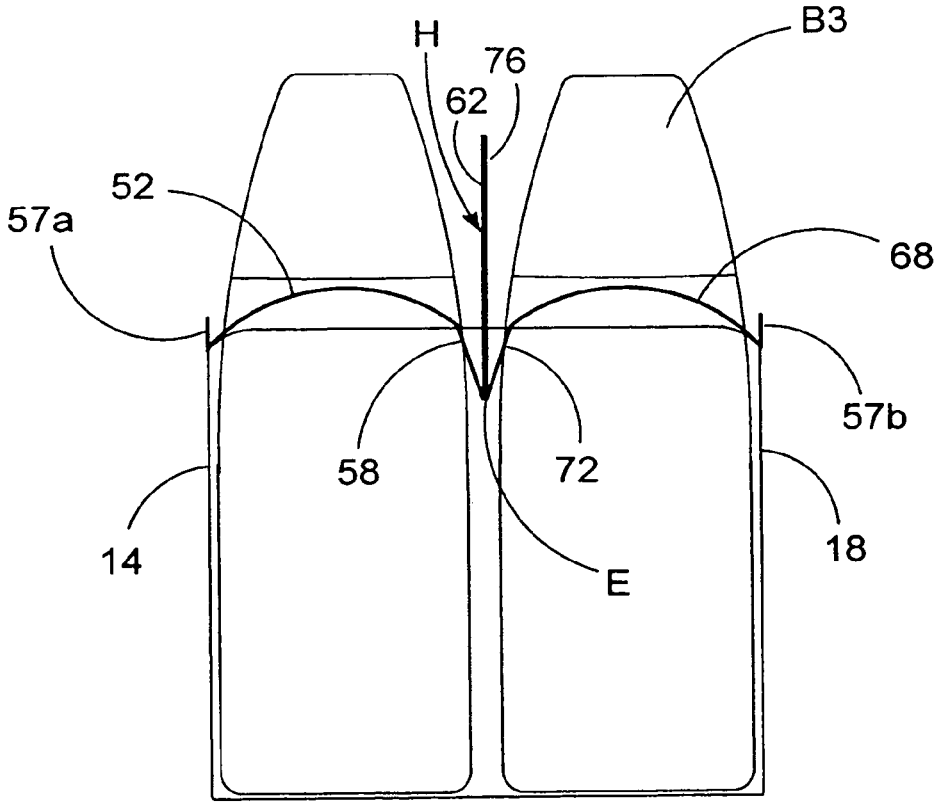
FIGS. 7, 8 and 9 are cross-section views of the article carrier shown in FIGS. 5 and 6 illustrating the pop-up effect of the handle structure.
Figure 8:
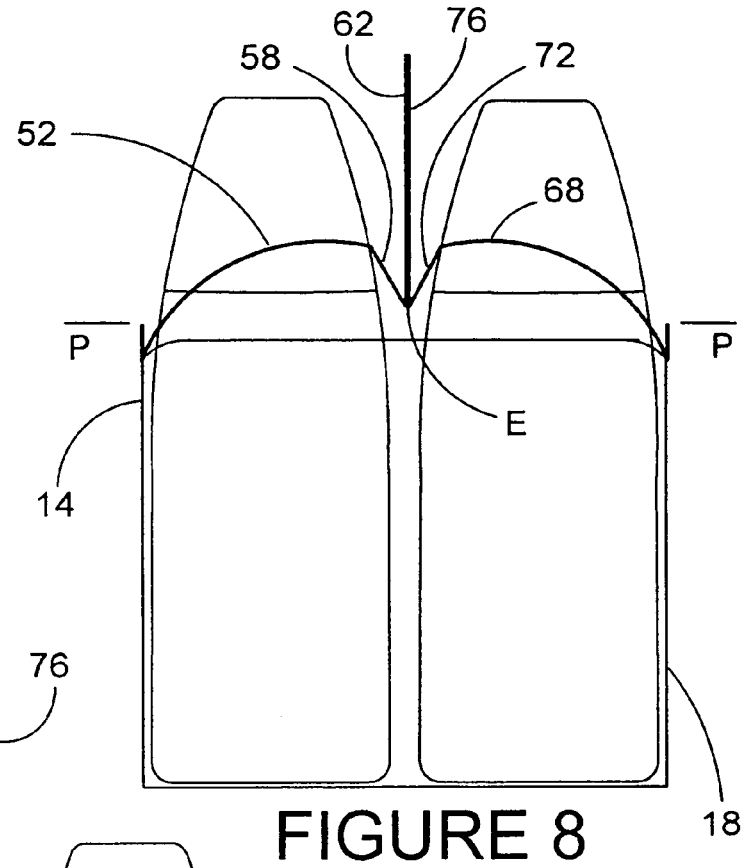

As the lower edge E (FIGS. 7 and 8) of the handle H drops beneath the horizontal plane P (FIG. 8) containing the upper side edges of the side walls 14, 18 the tension in the top panels forces the handle structure H downwards providing a automatic retracting effect so that the handle H is positioned below the tops of the bottles B3, as shown in FIGS. 6 and 7.

Figure 9:
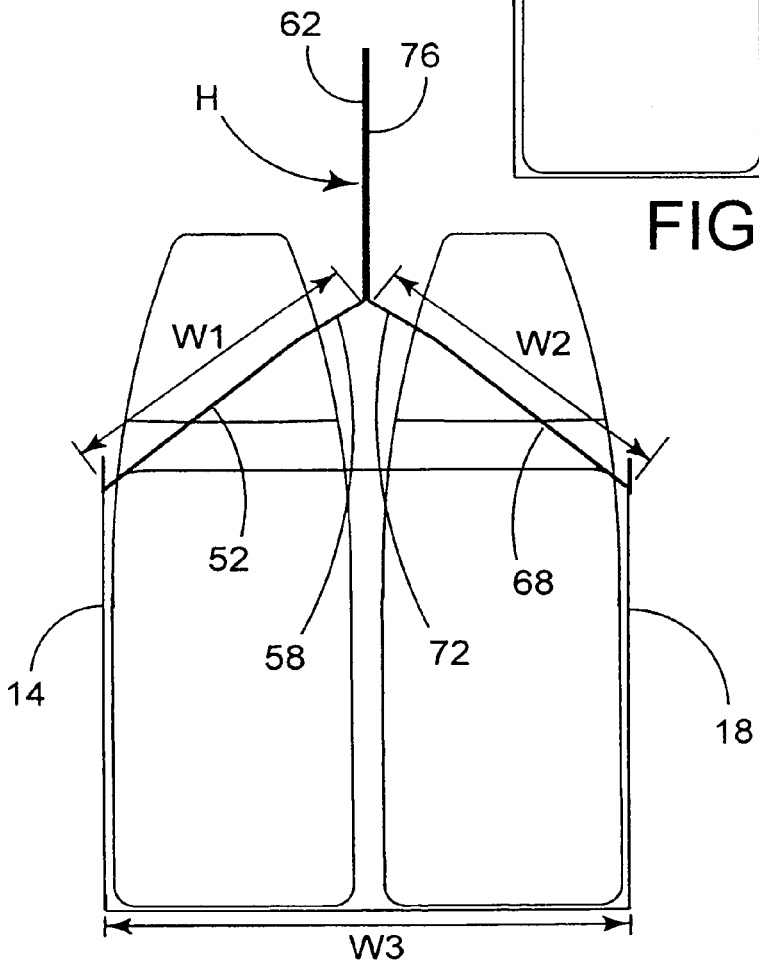

To assist in this handle movement, intermediate panels 58, 72 may be provided to act as articulating parts so that the handle H can move relative the top wall panels 52, 68. This results in the intermediate panels 58, 72 moving from an upwardly oriented position shown in FIG. 9 to a downwardly oriented position shown in FIG. 7 and reduces the prospect of the top panels creasing, or tearing.

Conversely, in order to move the handle H into a deployed position from the position in FIG. 7, the end user lifts the handle causing the top panels to be moved upwardly and the side wall panels 52, 68 and in some embodiments, the intermediate panels 58, 72 flex. As the lower edge E of handle H passes through the horizontal plane P shown in FIG. 8, the side walls 52, 68 force the handle structure upwards to cause a pop-up effect.

The 'pop up' and 'automatic retracting' effects are caused by making the width W1 and W2 of top panels (and optionally the intermediate panels) greater than the width of the end wall W3 thereby creating an imbalance effect in the horizontal plane P.

One advantage of employing the present invention is that the loaded carriers can be stored or shipped by stacking the carriers without destroying the integrity of the handle structure.

The present invention and its preferred embodiments relate to an arrangement for providing a retractable handle structure in a basket style carrier. However, it is anticipated that the invention can be applied to a variety of carriers, for example wrap around or fully enclosed cartons and is not limited to those of the type hereinbefore described.

It will be recognised that as used herein, directional references such as "top", "base", "end", "side", "inner", "outer", "upper" and "lower" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

It should be understood that various changes may be made within the scope of the present invention, for example, the size and shape of the panels and apertures may be adjusted to accommodate articles of differing size or shape, alternative base closure structures may be used. The article carrier may accommodate more than one article in different arrays.

What is claimed is:

1. An article carrier for carrying one or more articles, comprising a plurality of panels for forming opposed sides and ends of the article carrier including a pair of laterally disposed top wall panels hingedly connected to opposed side wall panels and a carrying handle hinged to the top wall panels, wherein the handle is movable between a retracted position and a deployed position which is at a higher elevation than the retracted position, wherein each of the top wall panels is sized and hinged to the handle and to a respective one of the side wall panels so that said each top wall panels flexes in such a manner that said each top wall panel is held in an arched form and under tension when the handle is in the retracted position and that the top wall panels are relieved from the tension and extend upwardly toward the handle when the handle is in the deployed position.

2. An article carrier according to claim 1 wherein the handle, when in the deployed position, is disposed above a horizontal plane containing the upper edges of the side wall panels and ,when in the retracted position, is disposed at least partially below said horizontal plane.

3. An article carrier as claimed in claim 1 further comprising an intermediate panel hingedly connecting the said each top wall panel to the handle and wherein the intermediate panels extend downward toward the handle when the handle is in the retracted position and upward toward the handle when the handle is in the deployed position.

4. An article carrier as claimed in claim 1 wherein said each top wall panel further comprises at least one aperture to receive an upper portion of an article.

5. An article carrier as claimed in claim 4 wherein the at least one aperture is generally ellipsoidal in shape so as to be circular in diameter in both the deployed and retracted positions.

6. An article carrier as claimed in claim 1 wherein said panels further include a pair of opposed end wall panels interconnecting said side wall panels.

7. A blank for forming an article carrier for carrying one or more articles, the blank comprising a plurality of panels for forming the opposed sides and ends of the article carrier, said panels including a first side wall panel, a first end wall panel hingedly connected to an end edge of said first side wall panel, a second side wall panel hingedly connected to an end edge of said first end wall panel, a second end wall panel hingedly connected to an end edge of said second side wall panel, a pair of top wall panels hingedly connected to upper edges of said side wall panels respectively, a pair of intermediate panels hingedly connected to upper edges of said top wall panels respectively, and a pair of handle panels hingedly connected to upper longitudinal edges of said intermediate panels respectively, wherein the total width of said intermediate panels and said handle panels is greater than the distance between said end edge of said first side wall panel and said end edge of said first end wall panel.

8. A blank as claimed in claim 7 wherein each of said handle panels extends entirely along said upper longitudinal edge of a respective one of said intermediate panels and is hingedly connected to said upper longitudinal edge of said respective intermediate panel.

9. A blank as claimed in claim 7 wherein each of said top wall panels comprises at least one aperture to receive an upper portion of an article.

10. A blank as claimed in claim 9 wherein the at least one aperture is ellipsoidal in shape.

11. An article carrier as claimed in claim 3 wherein the intermediate panels are disposed above a horizontal plane containing the upper edges of the side wall panels when the handle is in the deployed position, and the intermediate panels at least partially are disposed below said horizontal plane when the handle is in the retracted position.

12. An article carrier as claimed in claim 1 wherein said arched form is upwardly convex.

13. An article carrier as claimed in claim 6 wherein each of the end wall panels connects between adjacent end edges of the side wall panels.

14. An article carrier as claimed in claim 6 wherein the handle, when in the deployed position, is disposed above upper edges of the end wall panels and, when in the retracted position, is disposed at least partially below the upper edges of the end wall panels.

* * * * *